US010799749B2

(12) United States Patent
Sorin

(10) Patent No.: US 10,799,749 B2
(45) Date of Patent: Oct. 13, 2020

(54) WEIGHTED PIVOT ARM APPARATUS AND METHODS OF USE

(71) Applicant: Albert Sorin, Lexington, SC (US)

(72) Inventor: Albert Sorin, Lexington, SC (US)

( * ) Notice: Subject to any disclaimer, the term of this patent is extended or adjusted under 35 U.S.C. 154(b) by 0 days.

(21) Appl. No.: 16/239,128

(22) Filed: Jan. 3, 2019

(65) Prior Publication Data

US 2019/0201734 A1 Jul. 4, 2019

Related U.S. Application Data

(60) Provisional application No. 62/613,192, filed on Jan. 3, 2018.

(51) Int. Cl.

| | |
|---|---|
| ***A63B 21/06*** | (2006.01) |
| ***A63B 21/00*** | (2006.01) |
| ***A63B 1/00*** | (2006.01) |

(52) U.S. Cl.

CPC ..... *A63B 21/0617* (2015.10); *A63B 1/00* (2013.01); *A63B 21/00196* (2013.01); *A63B 21/159* (2013.01); *A63B 2225/09* (2013.01)

(58) Field of Classification Search

CPC ..... A63B 21/006; A63B 21/00047; A63B 21/008; A63B 21/14; A63B 21/1484; A63B 21/001; A63B 21/15

See application file for complete search history.

(56) References Cited

U.S. PATENT DOCUMENTS

| | | | | | |
|---|---|---|---|---|---|
| 3,858,873 | A * | 1/1975 | Jones | A63B 21/0615 | 482/97 |
| 3,912,261 | A * | 10/1975 | Lambert, Sr. | A63B 21/06 | 482/100 |
| 4,811,944 | A * | 3/1989 | Hoff | A63B 23/129 | 482/139 |
| 5,336,142 | A * | 8/1994 | Dalebout | A63B 21/00072 | 482/111 |
| 5,356,360 | A * | 10/1994 | Johns | A63B 21/155 | 482/100 |
| 6,036,622 | A * | 3/2000 | Gordon | A63B 21/154 | 482/51 |
| D550,791 | S * | 9/2007 | Rogers | D21/694 | |
| D550,792 | S * | 9/2007 | Rogers | D21/694 | |
| 7,641,602 | B2 * | 1/2010 | Rogers | A63B 21/0615 | 482/100 |
| 7,645,215 | B2 * | 1/2010 | Gordon | A63B 21/155 | 482/51 |
| 7,833,134 | B2 * | 11/2010 | Gordon | A63B 22/0017 | 482/51 |
| 7,918,771 | B2 * | 4/2011 | Rogers | A63B 21/0615 | 482/100 |
| 8,257,233 | B2 * | 9/2012 | Rogers | A63B 21/0615 | 482/100 |

(Continued)

*Primary Examiner* — Garrett K Atkinson

(74) *Attorney, Agent, or Firm* — Todd A. Serbin; Nexsen Pruet LLC

(57) ABSTRACT

A weighted pivot arm apparatus attached to a weight rack component, comprising: a body having an upper end and a lower end and extending along longitudinal axis; an attachment point disposed on the body comprising at least one wing with a hole therethrough and wherein the attachment point is rotatably mounted to the weight rack component; and, an impact bumper disposed on a lower end of the body.

20 Claims, 6 Drawing Sheets

(56) References Cited

U.S. PATENT DOCUMENTS

| | | | | |
|---|---|---|---|---|
| 8,517,899 | B2 * | 8/2013 | Zhou | A63B 69/182 482/138 |
| 8,876,665 | B1 * | 11/2014 | Isom | A63B 23/025 482/10 |
| 8,968,164 | B2 * | 3/2015 | Giannelli | A63B 21/154 482/102 |
| 9,248,333 | B2 * | 2/2016 | Staten | A63B 21/0618 |
| 9,358,420 | B2 * | 6/2016 | Funk | A63B 21/159 |
| 9,555,274 | B1 * | 1/2017 | Cassidy | A63B 21/00047 |
| 9,662,529 | B2 * | 5/2017 | Miller | A63B 21/00076 |
| 9,713,738 | B2 * | 7/2017 | Schrag | A63B 21/0087 |
| 9,950,205 | B2 * | 4/2018 | Simonetti | A63B 21/063 |
| 2007/0037667 | A1 * | 2/2007 | Gordon | A63B 21/155 482/51 |
| 2007/0155596 | A1 * | 7/2007 | Rogers | A63B 21/0615 482/97 |
| 2008/0132391 | A1 * | 6/2008 | Edeker | A63B 21/00 482/121 |
| 2010/0144496 | A1 * | 6/2010 | Schmidt | A63B 23/03533 482/70 |
| 2010/0152001 | A1 * | 6/2010 | Gordon | A63B 21/155 482/53 |
| 2016/0016033 | A1 * | 1/2016 | Schrag | A63B 21/0087 482/112 |
| 2017/0246496 | A1 * | 8/2017 | Nelson | A63B 21/4035 |

* cited by examiner

WEIGHTED PIVOT ARM APPARATUS AND METHODS OF USE

RELATED APPLICATION

This application claims the benefit of priority under 35 USC § 119(e) of U.S. Provisional Patent Application No. 62/613,192 filed Jan. 3, 2018, the contents of which are incorporated herein by reference in their entirety.

FIELD AND BACKGROUND OF THE INVENTION

The present invention, in some embodiments thereof, relates to the exercise industry and, more particularly, but not exclusively, to a weight rack, rack component, rig, station or similar attachment.

SUMMARY OF THE INVENTION

According to an aspect of some embodiments of the invention, there is provided a weighted pivot arm apparatus attached to a weight rack component, comprising: a body having an upper end and a lower end and extending along longitudinal axis; an attachment point disposed on the body comprising at least one wing with a hole therethrough and wherein the attachment point is rotatably mounted to the weight rack component; and, an impact bumper disposed on a lower end of the body.

In an embodiment of the invention, the apparatus further comprises a weight mount disposed on the body and sized and shaped for placing at least one weight plate thereon. In some embodiments, the weight mount is positioned on the body on the lower end.

In an embodiment of the invention, the body includes at least one hole sized and shaped for insertion of a pin therethrough.

In an embodiment of the invention, the apparatus further comprises a pin inserted into the hole of the attachment point and a hole on the weight rack component to rotatably secure the weighted pivot arm apparatus and the weight rack component together, wherein the hole of the weight rack component is aligned with the hold of the attachment point.

In an embodiment of the invention, the attachment point comprises two wings, one on each side of the body, configured with a distance between the wings corresponding to the width of the weight rack component such that the weight rack component fits between the two wings.

In an embodiment of the invention, the attachment point is a curved yoke.

In an embodiment of the invention, the apparatus is constructed with a built-in weight.

In an embodiment of the invention, an impact bumper is disposed on the body at the lower end. In some embodiments, the impact bumper is one of a plurality of interchangeable impact bumpers configured with different impact characteristics.

In an embodiment of the invention, the body is adjustable in length along the longitudinal axis. In some embodiments, the body comprises a plurality of telescoping sections which render the body adjustable in length.

In an embodiment of the invention, the attachment point is moveable along the length of the body along the longitudinal axis.

According to an aspect of some embodiments of the invention, there is further provided a method of using a weighted pivot arm apparatus, comprising: urging a rack component forward from a starting position; retracting the rack component; separating the weighted pivot arm apparatus from the rack component by the retracting, thereby rotating, around an attachment point, the weighted pivot arm apparatus relative to the rack component; returning the rack component towards the starting position as the weighted pivot arm apparatus falls towards the starting position while trailing the rack component; and, holding the rack component until the weighted pivot arm impacts the rack component.

In an embodiment of the invention, the holding includes either stopping movement of the rack component or moving the rack component forward.

In an embodiment of the invention, the method further comprises repeating urging through holding.

In an embodiment of the invention, the method further comprises interchanging a bumper exhibit a first impact characteristic with a second bumper exhibiting a second impact characteristic.

In an embodiment of the invention, the method further comprises performing urging through holding using two separate weighted pivot arm apparatuses simultaneously.

In an embodiment of the invention, the method further comprises placing at least one weight on a weight mount of the weighted pivot arm apparatus prior to urging.

In an embodiment of the invention, the method further comprises at least one of adjusting the length of the weighted pivot arm apparatus and adjusting the location of the attachment point.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE SEVERAL VIEWS OF THE DRAWINGS

Some embodiments of the invention are herein described, by way of example only, with reference to the accompanying drawings and photographic images (collectively, the "drawings"). With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings.

DESCRIPTION OF EMBODIMENTS OF THE INVENTION

Figure 1A:
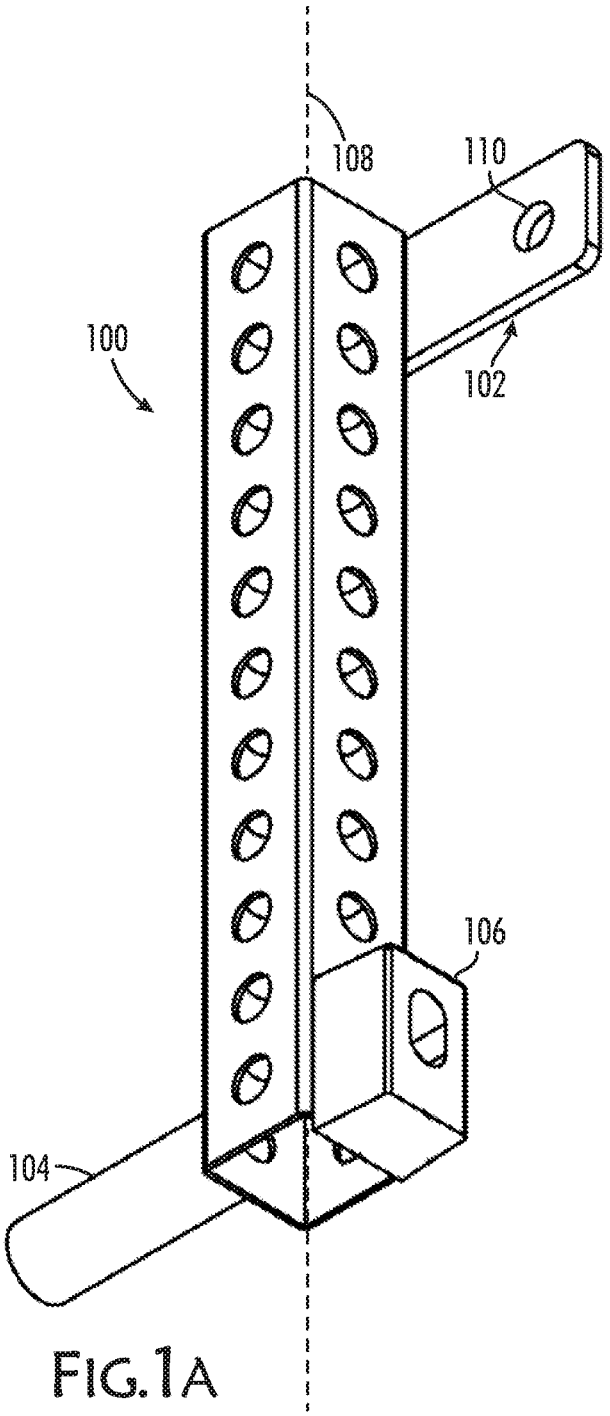
FIGS. 1A-1D are a perspective view, a rear view, a right-side view and a top view, respectively, of a weighted pivot arm apparatus.
Figure 1B:
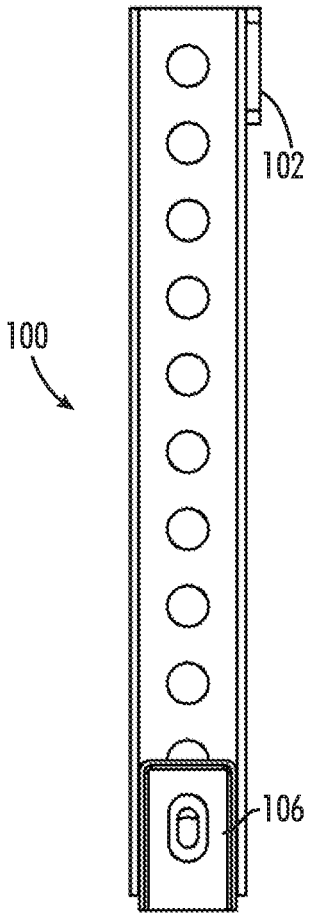
Figure 1C:
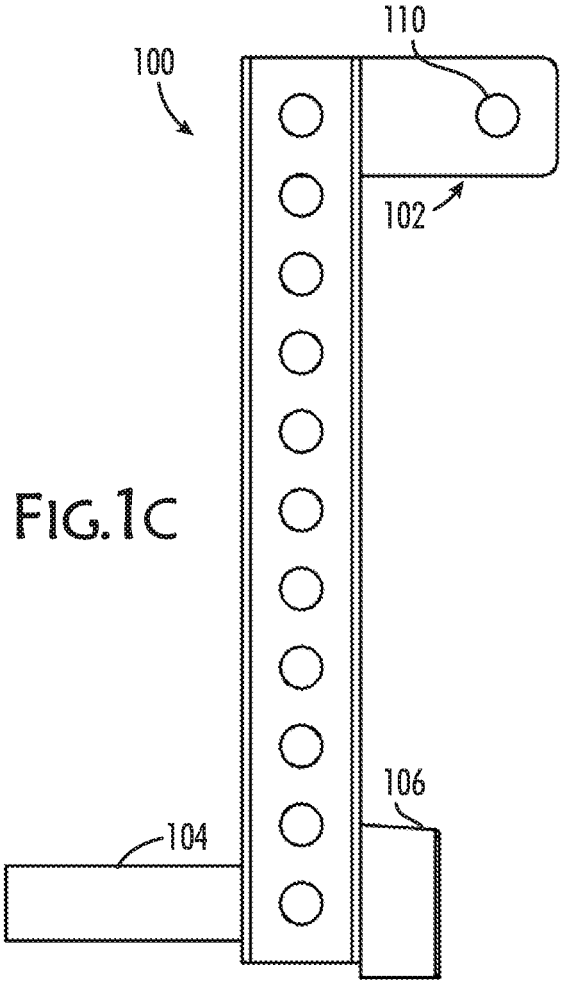
Figure 1D:
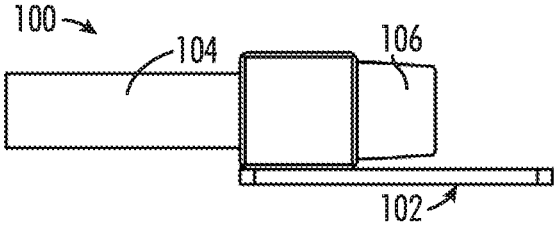

The present invention, in some embodiments thereof, relates to the exercise industry and, more particularly, but not exclusively, to a weight rack, rack component, rig, station or similar attachment.

Before explaining at least one embodiment of the invention in detail, it is to be understood that the invention is not necessarily limited in its application to the details of construction and the arrangement of the components and/or methods set forth in the following description and/or illustrated in the drawings. The invention is capable of other embodiments or of being practiced or carried out in various ways.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

Referring now to the drawings, FIGS. 1A-1D are a perspective view, a rear view, a right-side view and a top view, respectively, of a weighted pivot arm apparatus 100, in accordance with an exemplary embodiment of the invention. It is conceived that weighted pivot arm apparatus 100 (and other possible embodiments) can be used in combination with currently practiced exercise to provide a hammering or impact effect on a user of the presently described invention. It is believed by the inventor, that this impact effect is useful for creating a magnified impact, similar to being stuck with a hammer, which effectuates momentary increased G-Forces and/or shock waves into the body, specifically training connective tissue like the tendons and/or ligaments.

In an embodiment of the invention, a body of the apparatus 100 having an upper end and a lower end, is provided with an attachment/pivot point 102 which is, in turn, attached to a weight rack 400, a weight rack component 450 (shown and described in more detail with respect to FIGS. 4-6) or some other exercise apparatus (such as a rig or a station with a pivoting/rotating motion) for creating an abrupt impact intensification during exercise.

In an embodiment, the body of the weighted pivot arm apparatus 100 is optionally constructed of the same rack structure as the weight rack 400 and/or rack component, 450, for example including holes for mounting other weight rack related accessories and/or components. Optionally, the attachment pivot point 102 is itself attached to the body of the apparatus 100 in a moveable manner (e.g. using pins inserted through the at least one wing and the body) so that the pivot point relative to the apparatus 100 can be modified. In an embodiment of the invention, the body has a major dimension length (as opposed to a smaller, minor dimension) and a longitudinal axis 108 corresponding to that dimension.

Exemplary weight racks 400 include, for example, the Sorinex® Base Camp™ rack available at sorinex.com/product/base-camp-power-rack; weight rack components 450 or other exercise equipment to which the weighted pivot arm apparatus 100 can be attached include the Sorinex® Jammer Arm™ (found on the Web at sorinex.com/product/base-camp-jammer-arms) or the Sorinex® Hurricane™ (sorinex.com/product/sorinex-hurricane-2).

In an embodiment, the attachment point 102, nominally disposed at or near the upper end of the body, includes at least one wing configured with a hole 110, through which a pin 308 can be inserted to lock the apparatus 100 to the weight rack 400, weight rack component 450 or other exercise apparatus, wherein the weight rack 400, weight rack component 450 or other exercise apparatus has a corresponding hole through which the pin 308 is also inserted. Optionally, the attachment point 102 includes two wings, such as shown in FIGS. 3-6. In an embodiment of the invention, the pin/hole configuration allows for pivoting/rotating movement (relative to the weight rack 400, weight rack component 450 or other exercise apparatus) of the weighted pivot arm apparatus 100 around the pin 308, for example as the weighted pivot arm apparatus 100 is moved and/or the underlying weight rack 400, rack component 450 or other exercise apparatus is moved. As used herein, "weight rack", "rack component" and/or "other exercise apparatus" may be used interchangeably, with the understanding that it is intended that weighted pivot arm apparatuses 100, 300 described herein could be used with one, some or all of these types of apparatuses.

The weighted pivot arm apparatus 100 is optionally provided with a weight mount 104 for selectively adding at least one weight plate 402 (shown in FIGS. 4-5), in some embodiments. Additionally, alternatively and/or optionally, the weighted pivot arm apparatus 100 is pre-weighted, for example with a built in weight.

In some embodiments, the weighted pivot arm apparatus 100 is optionally provided with an impact bumper 106 at or near the lower end of the body to cushion against repetitive slamming of the weighted pivot arm apparatus 100, as a user is exercising, against the underlying rack component 450 to which the apparatus 100 is attached while still transferring kinetic energy to the user from movement of the weighted pivot arm apparatus 100. In some embodiments, the level of kinetic energy transferred to the user is modified by using different and/or interchangeable bumpers which exhibit different impact characteristics.

In some embodiments of the invention, at least a portion of the weighted pivot arm apparatus 100 is constructed of steel. In some embodiments of the invention, the impact bumper 106 is constructed of rubber and/or a natural and/or artificial equivalent.

In some embodiments, the length of the weighted pivot arm apparatus 100 is adjustable in length along the longitudinal axis 108 for modifying the effects of the apparatus 100 on the user. In some embodiments, the apparatus 100 comprises two or more telescoping structural elements to adjust length. As described elsewhere, additionally, alternatively and/or optionally, in some embodiments the pivot point moves along the body and along the longitudinal axis 108 to modify effects of the apparatus 100.

Figure 2:
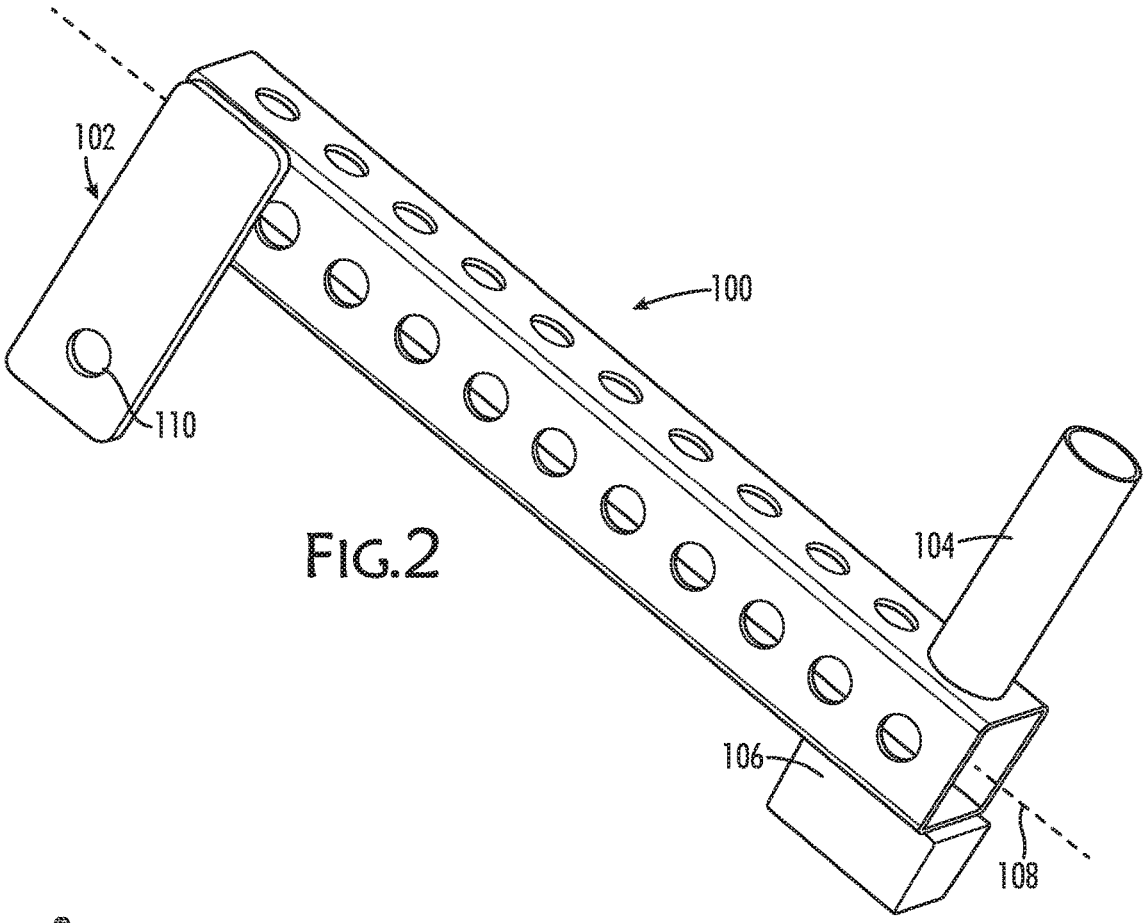
FIG. 2 is a left-side perspective view of the weighted pivot arm apparatus of FIGS. 1A-1D.

FIG. 2 is a left-side perspective view of the weighted pivot arm apparatus 100 of FIGS. 1A-1D, in accordance with an exemplary embodiment of the invention.

Figure 3:
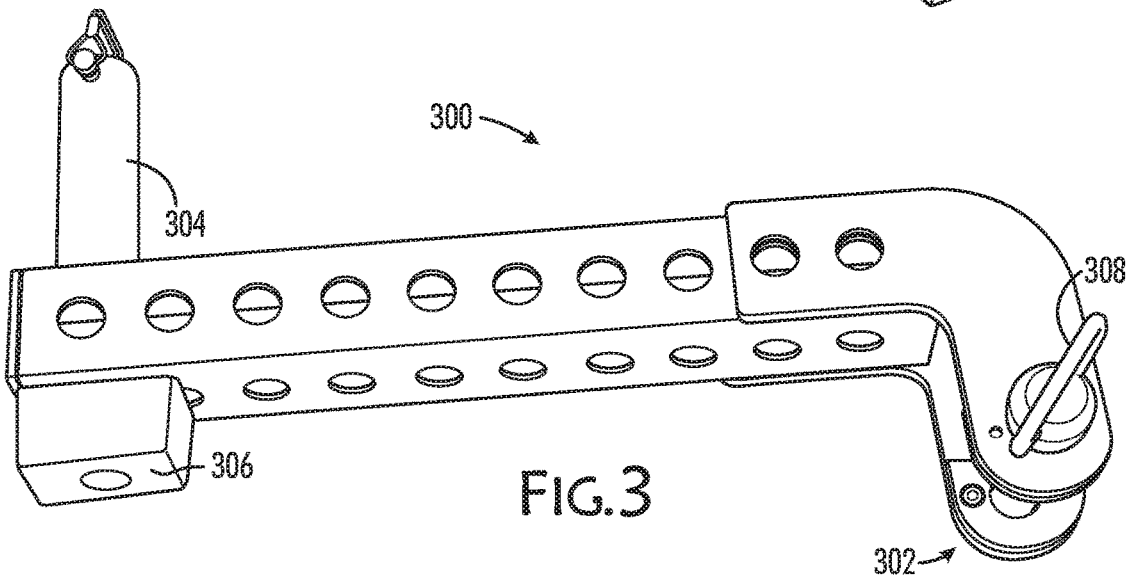
FIG. 3 is a perspective view of an alternative embodiment of a weighted pivot arm apparatus.

FIG. 3 is a perspective view of an alternate embodiment of a weighted pivot arm apparatus 300. In an embodiment of the invention, the attachment/pivot point 302 is shaped more like a curved yoke (rather than having a single wing like apparatus 100), which includes two wings to be placed on either side of an underlying weight rack 400, weight rack component 450 or other exercise apparatus to which the apparatus 100 is attached. In an embodiment, the weight mount 304 and the impact bumper 306 are similar to those used with respect to apparatus 100.

Figure 4:
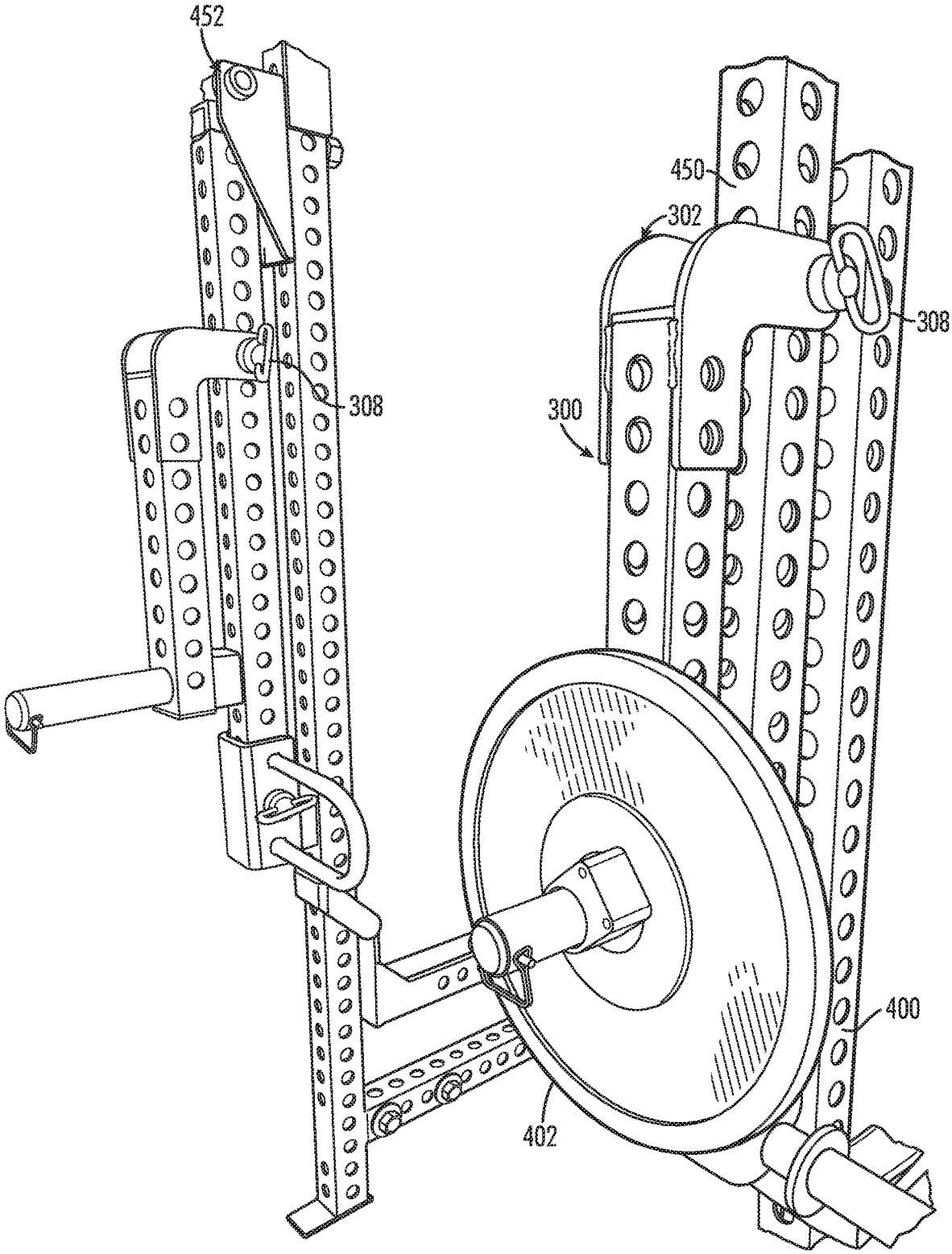
FIG. 4 is a perspective view of the weight pivot arm apparatus of FIG. 3 attached to a rack component.

FIG. 4 is a perspective view of the weight pivot arm apparatus 300 attached to a rack component 450 of a weight rack 400, in accordance with an exemplary embodiment of the invention. Of note is the attachment/pivot point 452 of the rack component 450.

Figure 5:
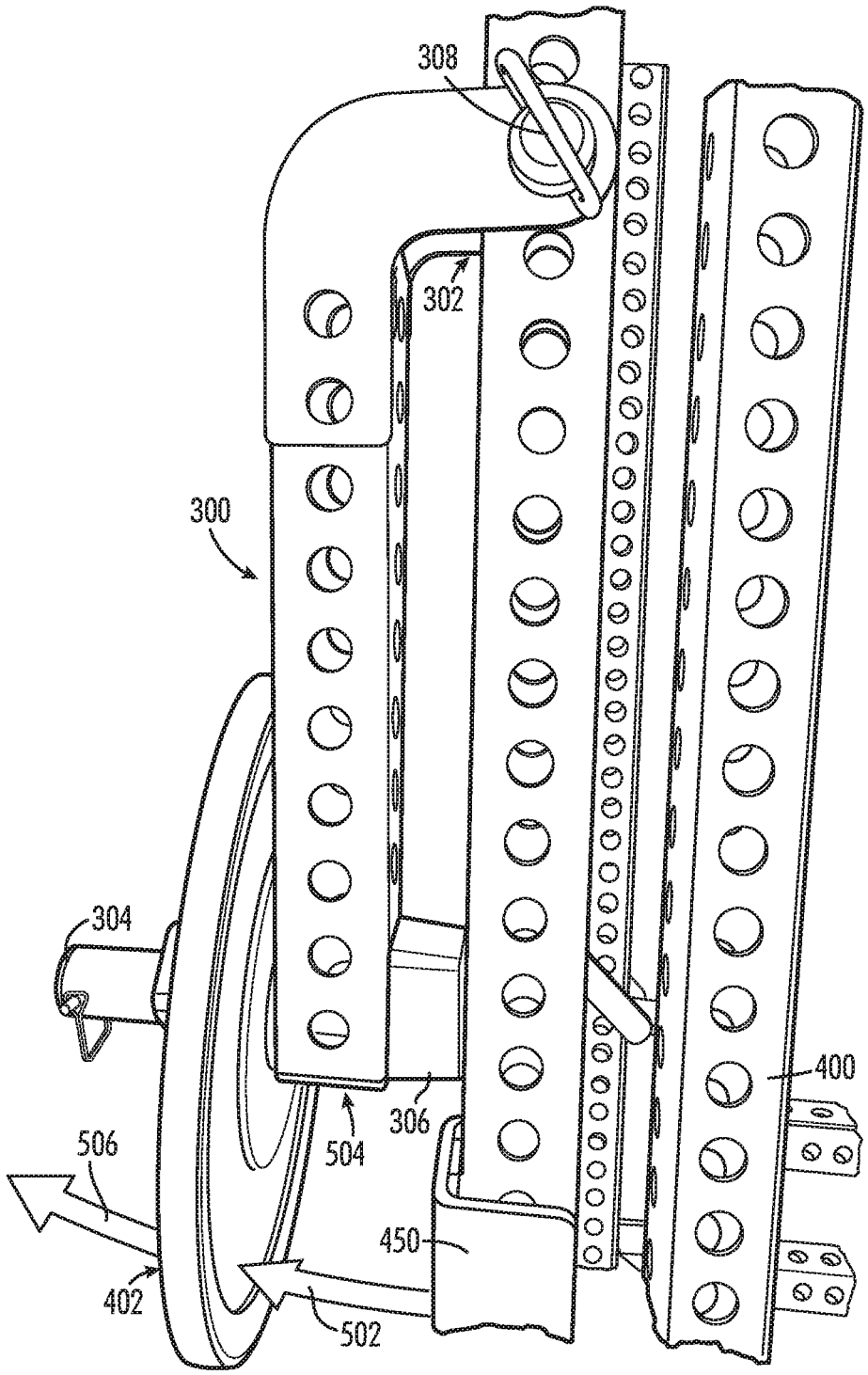
FIG. 5 is a right-side view of the weight pivot arm apparatus of FIG. 3 attached to a rack component; and, FIG. 6 is a flowchart of a method of using a weighted pivot arm apparatus.
Figure 6:
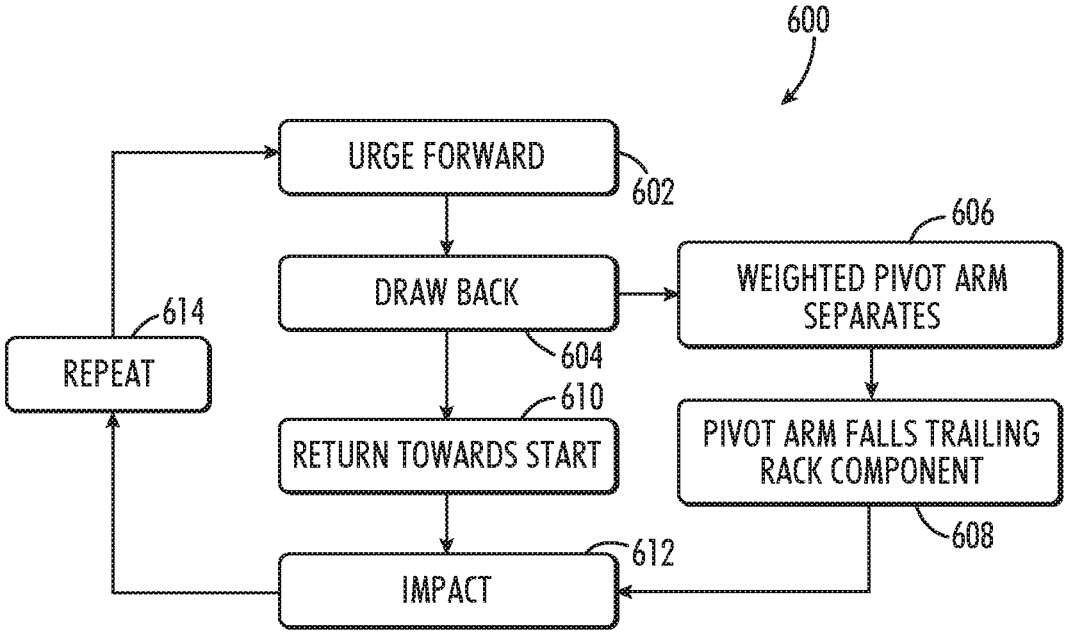

FIG. 5 is a right-side view of the weighted pivot arm apparatus 300 attached to the rack component 450 of the weight rack 400, in accordance with an exemplary embodiment of the invention. For brevity, a flowchart 600 of a method of using a weighted pivot arm apparatus 100, 300, in accordance with an exemplary embodiment of the invention, is described in conjunction with FIG. 5. In use, a user commences exercise, urging (602), for example, rack component 450 forward from a start position in direction 502 around the pivot point 452 of the rack component 450 (e.g. where it is attached to the weight rack 400), causing apparatus 300 to also move forward in direction 506 in conjunction with rack component 450.

In an embodiment of the invention, the user retracts (604) the rack component 450 quickly, causing the weighted pivot arm apparatus 300 to separate (606) from the rack component 450 (since the weighted pivot arm apparatus 300 is positioned relative to the rack component 450 such that the apparatus 300 is tied to forward movement of the rack component 450, but not backward/retracting movement) while rotating around attachment/pivot point 302 of the weighted pivot arm apparatus 300.

The user returns (610) the rack component 450 towards the start position as the now separated (606) weighted pivot arm apparatus 300 falls (608) via gravity towards the start position while trailing the rack component 450, in an embodiment of the invention. At some point in the user's motion with the rack component 450, either when the user stops or when the user starts a repeat movement forward with the rack component 450, the weighted pivot arm attachment 300 impacts (612) the rack component 450 being held by the user and imparting kinetic energy (similar to being struck with a hammer) into the user's body. This momentary stressor is thought to induce a training effect on the connective tissue, not only the muscles, and lead to stronger and more durable tendons and ligaments.

In some embodiments, the user repeats (614) the exercise.

In some optional embodiments, the user imparts such a forceful forward 502 thrust against the rack component 450 during urging (602), the weight mount end 504 of weighted pivot arm apparatus 300 is thrown off of the rack component 450 by the forward movement, causing the end 504 to separate (606) from the rack component 450 at this forward movement stage instead of during retraction (604).

It should be noted that in some embodiments, the weight, the pivot point location, and/or the length of the weighted pivot arm apparatus 100, 300 is variable/configurable to vary lag time (time/distance of travel after separation (606) and during falling (608)) and/or intensity of impact. In some embodiments, elastic bands are added to connect the weighted pivot arm apparatus 100, 300 to the underlying weight rack 400, weight rack component 450 or other exercise apparatus to increase impact force, to increase the forward force required of the user to separate the weighted pivot arm apparatus 100, 300 from the rack component 450 and/or to reduce lag time.

The terms "comprises", "comprising", "includes", "including", "having" and their conjugates mean "including but not limited to".

The term "consisting of" means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

The term "plurality" means "two or more".

As used herein, the singular form "a", "an" and "the" include plural references unless the context clearly dictates otherwise. For example, the term "a compound" or "at least one compound" may include a plurality of compounds, including mixtures thereof.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6 and numbers which fall outside of this range subject to limitations of state-of the art measuring equipment. This applies regardless of the breadth of the range.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A weighted pivot arm apparatus attached to a weight rack component, the weight rack component configured for moveable attachment to a weight rack, such that the weight rack component is disposed between the weighted pivot arm apparatus and the weight rack, comprising:

a body having an upper end and a lower end and extending along longitudinal axis;

an attachment bracket rigidly affixed to the body comprising at least one wing with a hole therethrough and wherein the attachment bracket is configured for rotatable mounting to the weight rack component; and, an impact bumper disposed on a lower end of the body.

2. The weighted pivot arm apparatus of claim 1, further comprising a weight mount disposed on the body and sized and shaped for placing at least one weight plate thereon.

3. The weighted pivot arm apparatus of claim 2, wherein the weight mount is positioned on the body on the lower end.

4. The weighted pivot arm apparatus of claim 1, wherein the body includes at least one hole sized and shaped for insertion of a pin therethrough.

5. The weighted pivot arm apparatus of claim 4, further comprising a pin inserted into the hole of the attachment bracket and a hole on the weight rack component to rotatably secure the weighted pivot arm apparatus and the weight rack component together, wherein the hole of the weight rack component is aligned with the hold of the attachment bracket.

6. The weighted pivot arm apparatus of claim 1, wherein the attachment bracket comprises two wings, one on each side of the body, configured with a distance between the wings corresponding to the width of the weight rack component such that the weight rack component fits between the two wings.

7. The weighted pivot arm apparatus of claim 1, wherein the attachment bracket is a curved yoke.

8. The weighted pivot arm apparatus of claim 1, wherein the apparatus is constructed with a built-in weight.

9. The weighted pivot arm apparatus of claim 1, wherein an impact bumper is disposed on the body at the lower end.

10. The weighted pivot arm apparatus of claim 9, wherein the impact bumper is one of a plurality of interchangeable impact bumpers configured with different impact characteristics.

11. The weighted pivot arm apparatus of claim 1, wherein the body is adjustable in length along the longitudinal axis.

12. The weighted pivot arm apparatus of claim 11, wherein the body comprises a plurality of telescoping sections which render the body adjustable in length.

13. The weighted pivot arm apparatus of claim 1, wherein the attachment bracket is moveable along the length of the body along the longitudinal axis.

14. A method of using a weighted pivot arm apparatus attached to a weight rack component which is configured for moveable attachment to a weight rack, such that the weight rack component is disposed between the weighted pivot arm apparatus and the weight rack, comprising:

urging the weight rack component forward from a starting position;

retracting the weight rack component;

separating the weighted pivot arm apparatus, having a body having an upper end and a lower end and extending along longitudinal, from the weight rack component by the retracting, thereby rotating the weighted pivot arm apparatus relative to the weight rack component, around an attachment bracket rigidly affixed to the body comprising at least one wing with a hole therethrough and wherein the attachment bracket is configured for rotatable mounting to the weight rack component;

returning the weight rack component towards the starting position as the weighted pivot arm apparatus falls towards the starting position while trailing the weight rack component; and, holding the rack component until an impact bumper disposed on a lower end of the body of the weighted pivot arm impacts the weight rack component.

15. The method according to claim 14, wherein holding includes either stopping movement of the weight rack component or moving the weight rack component forward.

16. The method according to claim 14, further comprising repeating urging through holding.

17. The method according to claim 14, further comprising interchanging a bumper exhibit a first impact characteristic with a second bumper exhibiting a second impact characteristic.

18. The method according to claim 14, further comprising performing urging through holding using two separate weighted pivot arm apparatuses simultaneously.

19. The method according to claim 14, further comprising placing at least one weight on a weight mount of the weighted pivot arm apparatus prior to urging.

20. The method according to claim 14, further comprising at least one of adjusting the length of the weighted pivot arm apparatus and adjusting the location of the attachment bracket.

* * * * *